United States Patent [19]

Coombs et al.

[11] Patent Number: 4,977,432

[45] Date of Patent: Dec. 11, 1990

[54] DECURLING AND OFFSETTING DEVICE

[75] Inventors: Peter M. Coombs, Tustin; Hans Graafmans, Huntington Beach, both of Calif.

[73] Assignee: Gradco Systems, Inc., Irvine, Calif.

[21] Appl. No.: 218,396

[22] Filed: Jul. 13, 1988

[51] Int. Cl.[5] ..... G03G 15/00; B65H 29/00

[52] U.S. Cl. ..... 355/309; 355/322; 162/271; 271/184; 271/81

[58] Field of Search ..... 355/309, 311, 321, 322; 162/270, 271; 271/278, 207, 209, 184, 185, 188, 81; 493/395, 459–461

[56] References Cited

U.S. PATENT DOCUMENTS 4,591,259 5/1986 Kuo et al. ..... 355/309

4,635,920 1/1987 Kodama ..... 271/184 X

FOREIGN PATENT DOCUMENTS 61-60554 3/1986 Japan .

*Primary Examiner*—Joan H. Pendegrass

*Attorney, Agent, or Firm*—Newton H. Lee, Jr.

[57] ABSTRACT

A device is disposed in the path of paper leaving a printing unit or processor such as an office copier, facsimile or non-impact printer and has an arcuate concave guide and a feed roll which causes the paper to pass between the guide and the feed roll to decurl the paper. The space between the guide and the roller is greater than the thickness of the paper and the paper is bent in the direction opposite to its curl as it passes through the arched space, while the beam strength of the paper and the change in direction of the paper maintain adequate drive friction on the paper. The feed roll is mounted for movement laterally of the direction of paper travel to cause it to be laterally displaced or offset.

1 Claim, 6 Drawing Sheets

DECURLING AND OFFSETTING DEVICE

BACKGROUND OF THE INVENTION

One of the factors or problems encountered in electrostatic printing or xerography in office copiers, facsimile machines and printers in which the image is fused on the paper under heat and pressure is that the process tends to cause a curl to be formed in the paper.

Curled paper is difficult to handle in a receiver for the sheets. Ideally the sets should be neat with edges aligned and easy to handle by an operator or in finishing apparatus in which the set may be stitched or stapled.

The curl problems with paper stem from the treatment of the sheets in the processor. A sheet of normal paper is taken from a supply source, such as a cassette or feeder, in an environment in which the paper is subject to humidity and absorbs a certain amount of moisture. The sheet is processed past a photo conductor where powder or liquid ink is applied to produce an image, and then the sheet is passed through a fuser and subjected to heat and pressure between rollers, with the result that normal, flat sheets are caused to curl. Curled sheets received in a collator or sorter in bins cause failure of the device due to jamming or mis-sorting of sheets and the bin capacity of the receiver is reduced. In addition, curled sheets do not tend to form neat stacks or sets when received in a simple receiver may, as in the case of some printers or copiers and facsimile machines.

In efforts to minimize curl problems in copiers and printers, the feed rolls may be modified or bins made larger, but there has been, prior to the invention described in my pending application Ser. No. 122,145 filed Nov. 17, 1987, no way to remove the curl from paper sheets by returning them to their original, normal flat condition, without requiring the use of complex positively driven rolls with large power consumption and tracking or the problems resulting from the use of pressure plates or springs and the like, wrinkling of sheets or smearing of print.

The device of the aforesaid application is very useful in conjunction with most copier, printer and facsimile machines. However, when such machines are not attended and/or multiple users are producing sets of different printed material, the different sets are indiscretely stacked one on the other causing manual problems in set or job separation upon removal from the receiver.

It is known that sets of sheets forming a copy of a document may be offset by angularly or laterally offsetting or shifting the sheet feed rolls or by laterally offsetting the receiver tray. Such offsetting devices are generally complicated and require considerable space.

In the modern day facsimile machines, space is at a premium and curling of sheets, as described above, is a severe problem due to the fact that the predominance of facsimile machines store paper on a tight roll.

SUMMARY OF THE INVENTION

The present invention provides a decurler useful between the fusing station of a electrostatic printing machine, such as an office copier or printer, facsimile machine or the like, and the receiver for printed sheets, wherein the decurler is provided with a sheet offsetting capability without occupying additional space or combining in tandem a decurling and a subsequent offsetting operation.

The device specifically disclosed in the aforesaid application and in combination with the offset means disclosed herein flattens the curl due to movement of the sheet through a gap between an arched plate and a driven roller without applying positive compressive pressure to the sheet between the plate and the roller. However, the decurler, in a broad sense, in the case of combined decurling and offsetting functions in accordance with the present invention, could be a decurler which applies decurling direct pressure to the sheet, such as the decurler shown in U.S. Pat. No. 4,591,259, May 27, 1986, or other similar pressure decurler which press the sheet.

More particularly, in the specifically disclosed, preferred decurler of my pending application specified above, the arched guide and opposing, spaced rollers are placed in the paper path between the point where the paper leaves the fusing station in the processor and the point at which a sheet is deposited in the receiver. The arched plate and roller form a guide with a gap on a reverse curve, compared to the curl in the sheet, the gap being thicker than the paper so that no positive compressive pressure is applied to the sheet.

The advantages of such a decurler include a reduction in moving parts, reduced tendency to wrinkle the paper or smear printing due to high friction forces, reduced power requirements, and a small compact structure, capable of decurling paper moving at high feed rates.

In a preferred form, the decurler includes a gate which can be opened to permit a flat sheet of paper to be fed through the device without passage through the decurling gap, thereby isolating the decurler.

The decurler, in accordance with the present invention combines an offsetting function by shifting the driven roller on its axis in one direction or the other so as to cause sheets to be laterally offset upon exit from the decurler. By taking advantage of the ability to offset the sheet in the decurler, a minimum of space is required.

The invention has other features and advantages which may be more apparent from an understanding of an embodiment thereof illustrated in the accompanying drawings and described in the following detailed description.

DESCRIPTION OF THE PREFERRED EMBODIMENT

Figure 1:
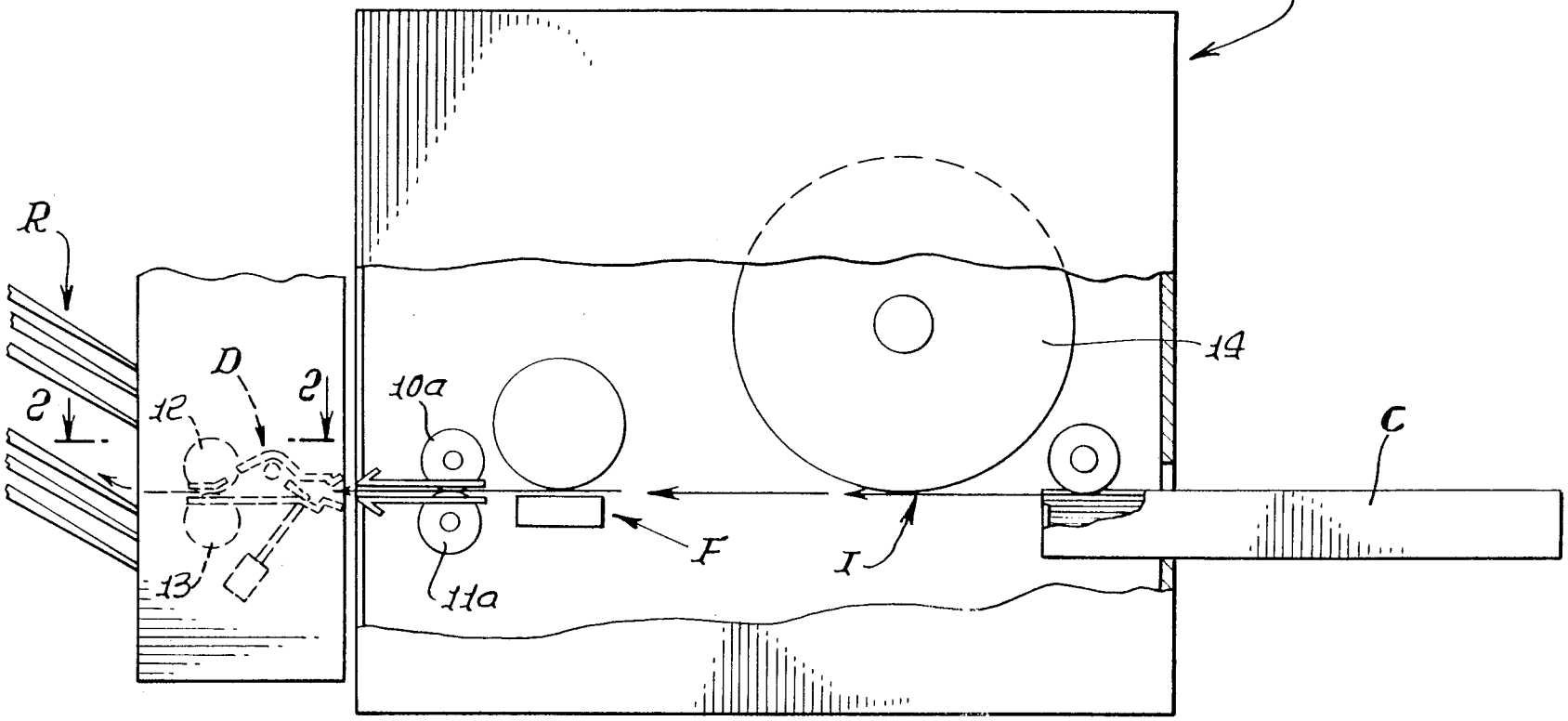
FIG. 1 is a side elevation showing a printing machine having a sorter and to which the decurler of the invention is applied.
Figure 2:
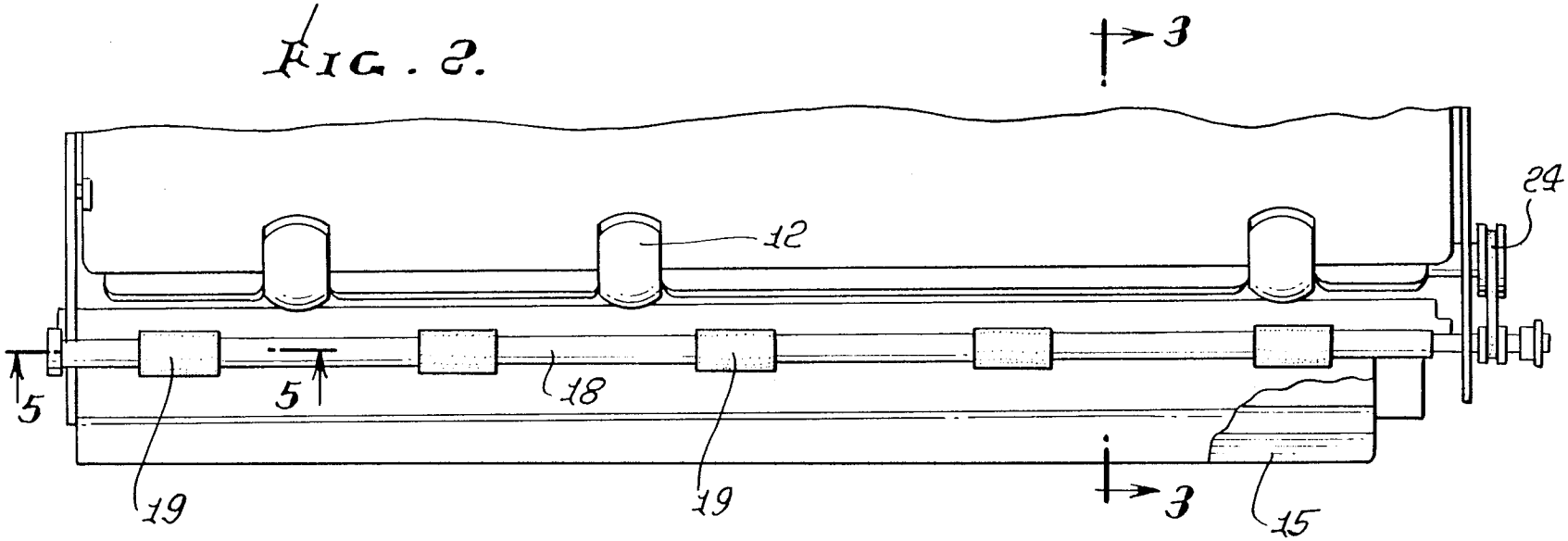
FIG. 2 is a horizontal section on the line 2—2 of 1.

As seen in the drawings a processor P which may be a xerographic copier, a non-impact printer or other processor, such as a facsimile machine transfers images at an imaging station I to sheets of paper supplied from a cassette or other feeder C, the sheets then passing to a fusing station F at which the image is fused on the paper under heat and pressure.

Printed sheets then are transferred by exit rolls 10*a* and 11*a*, pass through a decurler D in accordance with the invention, and are transported by feed rolls 12 and 13 in the form shown in FIGS. 1 through 5, to a suitable receiver R, which may be a single tray, a stacker for printed sets, or a collator for printed sheets. The details of the processor P and the receiver R are not germane to the present invention, except to note that, as well known in the art of xerography or electrophotography printers and facsimile machines sheets fed from the cassette or feeder C pass through the imaging station I at which the print media is deposited on the sheet at the large drum 14 and the sheet then moves to the fusing station F and is transported in the left-hand direction, as viewed in FIG. 1, through decurler D to the rolls 12 and 13 which as shown are input feed rolls for transporting the printed sheets to the receiver R shown as a sorter having trays adapted to receive sets of sheets.

The decurler D is interposed, in the illustrative embodiment of FIGS. 1 through 5, between the sets of rollers 10*a*, 11*a* and 12.13 whereby sheets are fed to the decurler and from the decurler to the receiver. The decurler will be seen to be a very simple device, consisting of very few components, namely, a fixed guide 15 formed with a concave arc at 16 and suitably fixed in the frame structure 17, a rotary shaft 18 which extends horizontally and has soft rubber or rubber-like rollers 19 thereon formed with a diameter complementing the radius of the arc 16 in guide 15 so that, as seen, the arc 16 and the outer surfaces of the rollers are parallel through a chordal section of the gap at which the sheet is primarily deformed. Bearings 20 for the shaft 18 are mounted on the frame structure and suitably secured in place. A belt drive 22, powered by a motor (not shown) drives shaft 18 and also drives the feed rolls 12 through an O-ring 24 to transport sheets from the decurler to the receiver.

Figure 4:
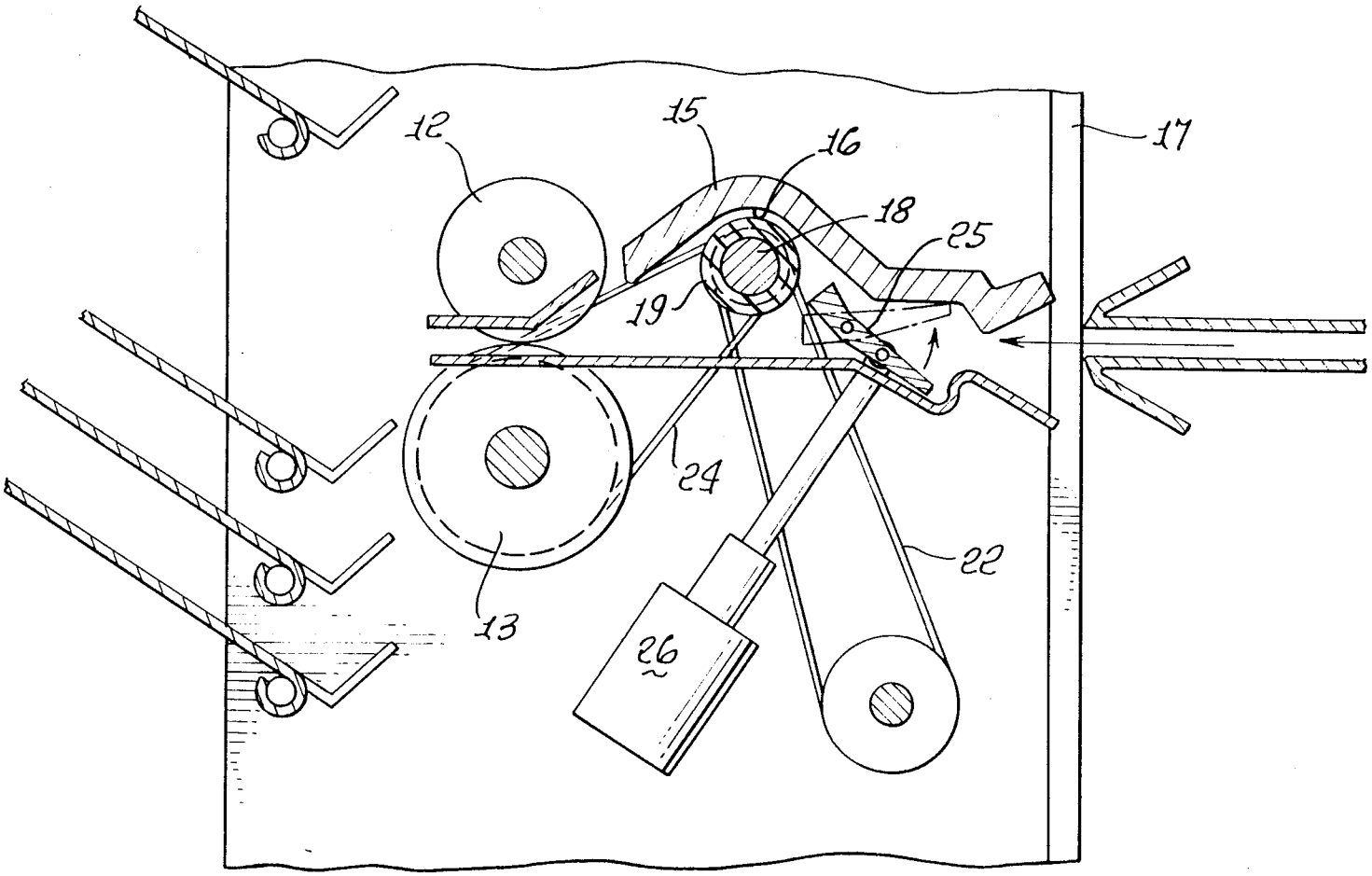
FIG. 4 is an enlarged detail view in vertical section illustrating the operation of the decurler.

In the form shown, the decurler also includes a gate 25 pivotal to the full line position of FIG. 4 by a solenoid 26 to the full line position and returnable to the broken line position by a suitable return spring. In the full line position of the gate, each sheet fed through he device is deflected to pass between guide 15 and rollers 19, while in the broken line position of the gate the sheets are allowed to pass straight through from rolls 10 and 11 to rolls 12 and 13. This gate feature is of advantage when thick cardboard-like sheets are being processed, or wherein the sheets have not been curled at the fuser F. In the full line gate position, it is effectively a portion of a mouth for the decurler into which leading edges of sheets pass and are deflected towards the arched section 16 of the guide 15.

Figure 5:
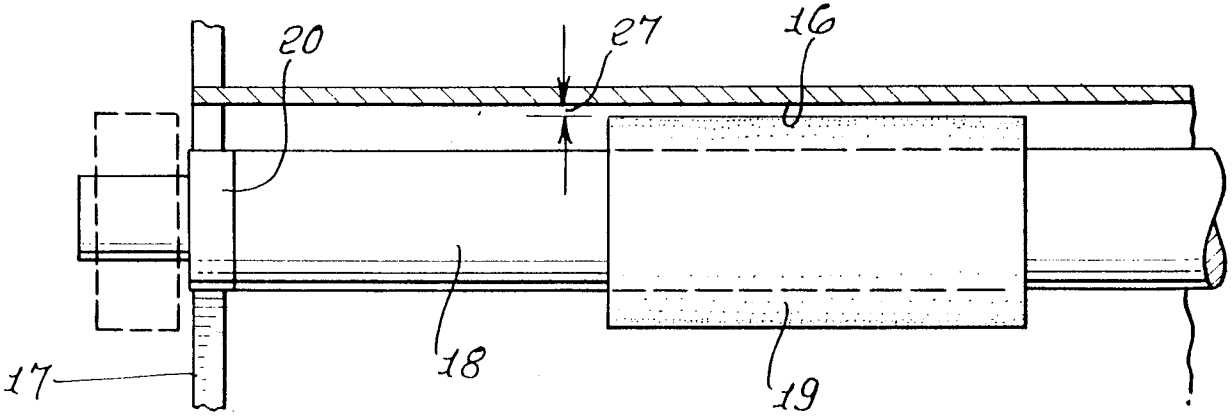
FIG. 5 is an enlarged fragmentary section on line 5—5 of FIG. 1. showing details of the decurler.
Figure 3:
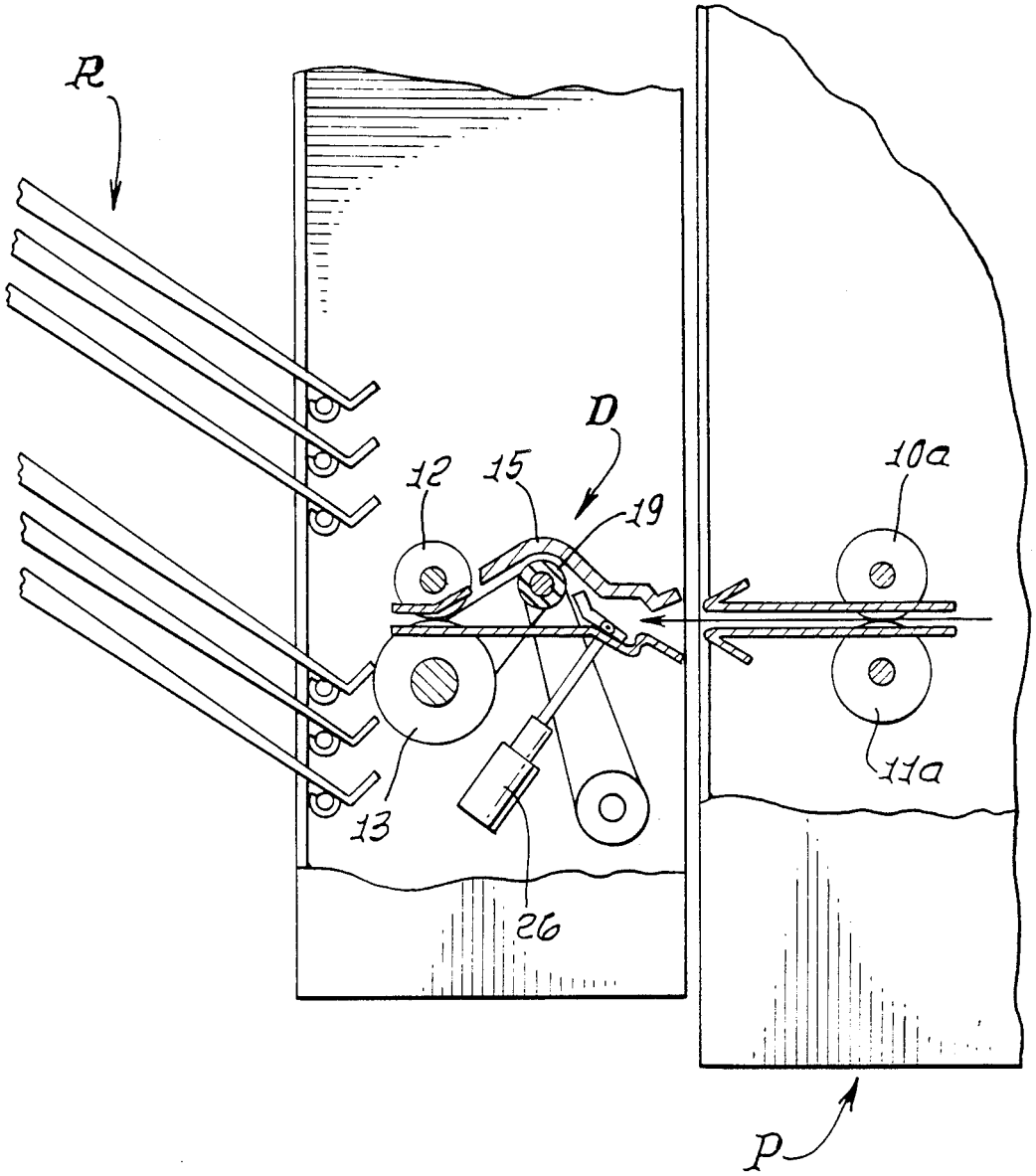
FIG. 3 is a vertical section on the line 3—3 of FIG. 2.

As seen in FIGS. 4 and 5 the bearings 20 for the shaft 18 are positioned with respect to the arched guide section 16 so that there is an arcuate gap 27 which is wider radially than the thickness of a sheet of paper, so that sheets pass through the gap without applied compressive force. The arcuate gap 27 is arched oppositely to the curl in the sheet, so that as the sheet passes through the gap, the curl is bent in the opposite direction.

The coefficient of friction between the driven rollers 19 and the paper sheets and the beam strength of the paper as it is forced to bend in the arched section 16 of the guide maintains adequate frictional drive for the paper, after its trailing edge leaves the positively driven rolls 10*a* and 11*a*, in the case that the paper path from the rollers 10*a* and 11*a* through the decurler and to the driven rolls 12 and 13 exceeds the length of the sheet.

Figure 6:
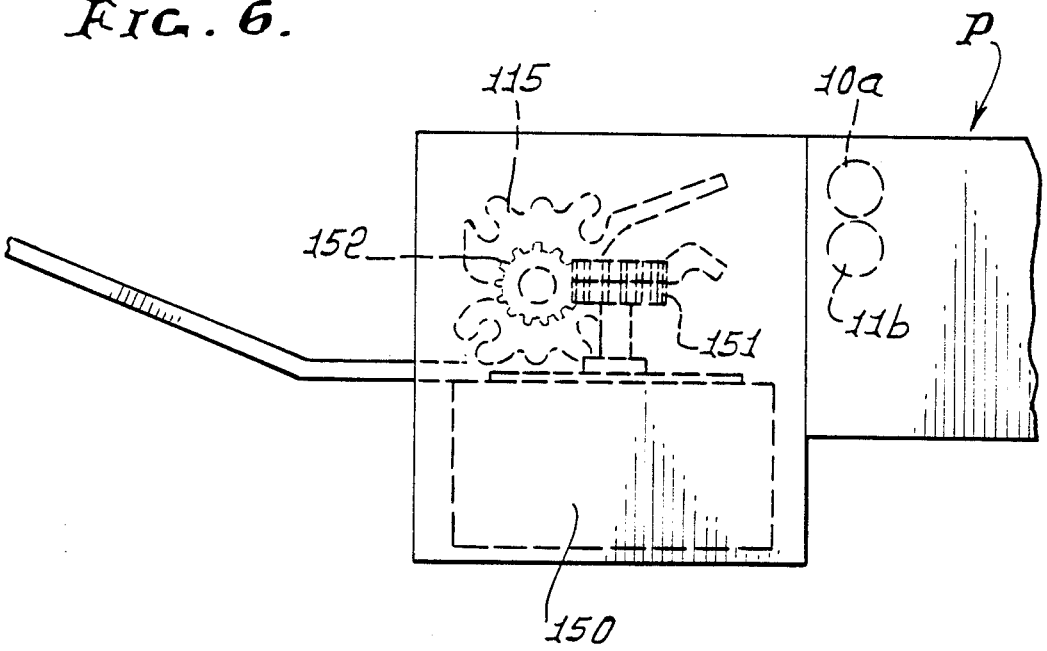
FIG. 6 is a fragmentary view in side elevation showing the application of the offsetting feature to the apparatus.
Figure 8:
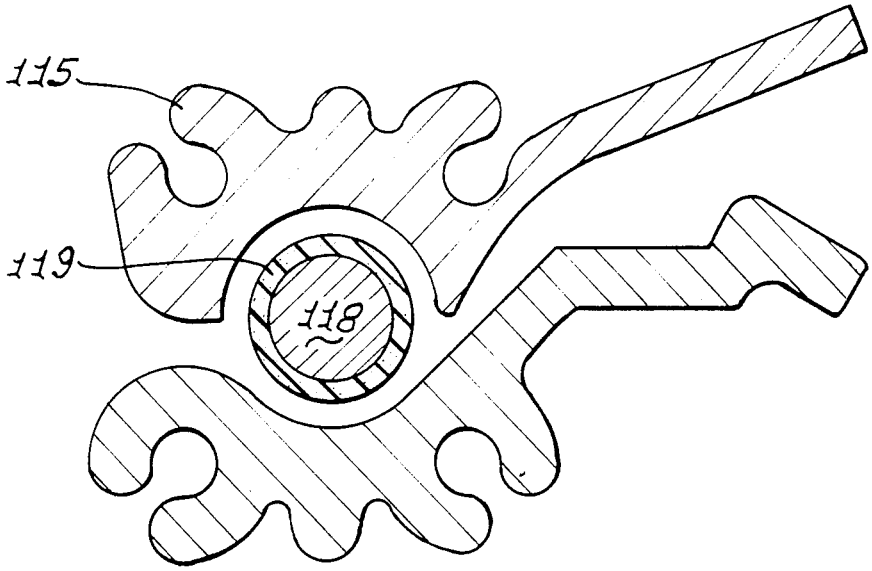
FIG. 8 is a vertical section on the line 8–8 of FIG. 7.
Figure 7:
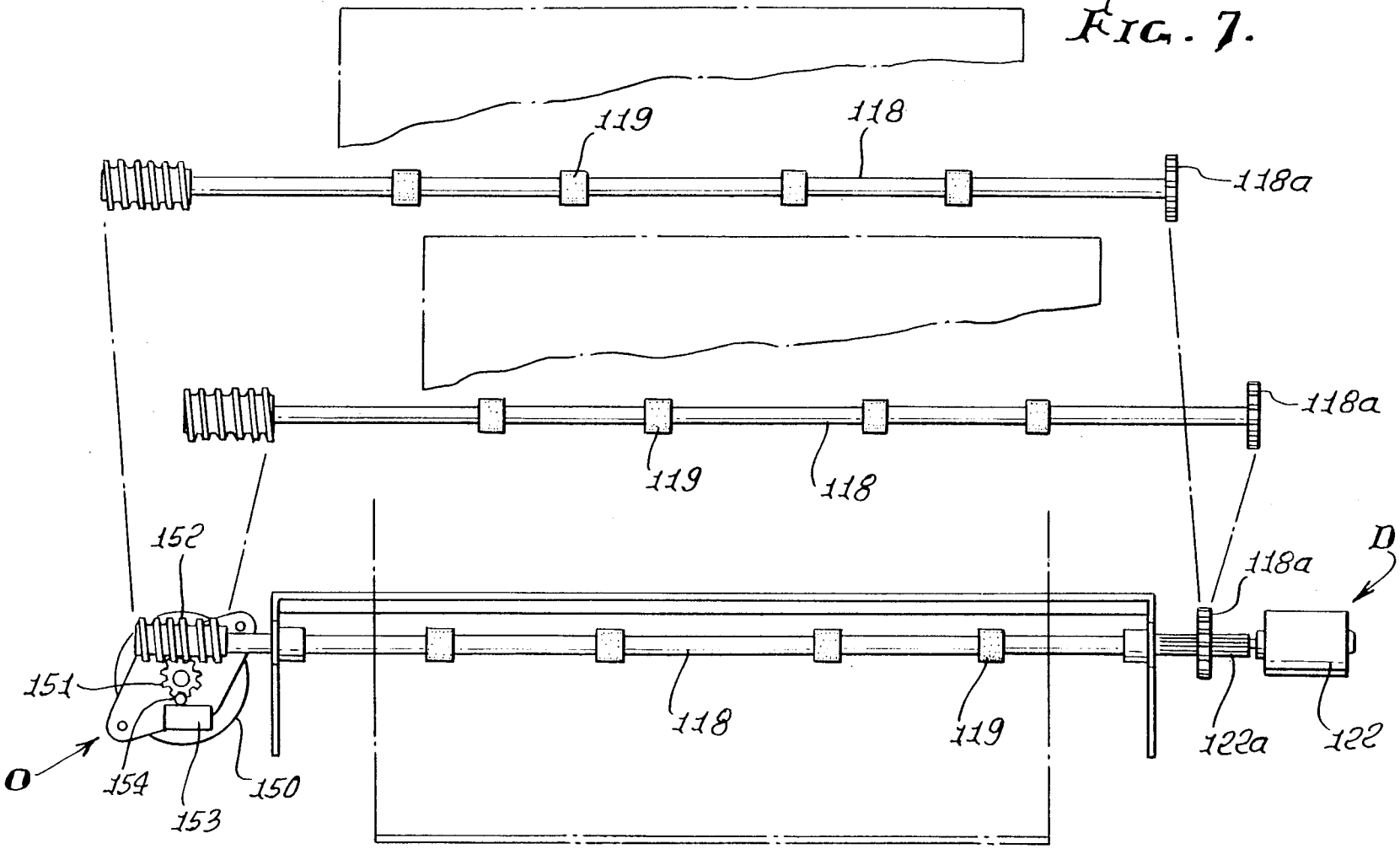
FIG. 7 is a top plan showing the offsetting apparatus and diagrammatically showing multiple offset positions.

As seen in FIGS. 6 through 8, the sheet is fed directly to the receiver tray without need for feed rolls 12 and 13, as previously described. In this form, the invention is applicable with ease to the typical printing (including facsimile and laser printers) machines currently available, in the small space between the output rolls 10*a* and 11*a* of the printing machine and the receiver tray.

Here, the structure is essentially the same, as previously described, and, without further detailed description will be understood to effect decurling between the arched guide plate 115 and the rollers 119 on feed shaft 118.

However, in accordance with the offsetting feature of the present invention, the shaft 118 is adapted to be selectively longitudinally shifted, as diagrammatically illustrated in FIG. 7, so that sheets are fed to the tray in selected, laterally offset positions. In the case of computer controlled printers and facsimile machines, which produce sets which are inherently arranged sequentially, so as not to require collating, this enables a lateral separation between "jobs" or documents being received.

To accomplish this, a drive motor 122 for shaft 118 has its drive pinion 122*a* elongated to slidably engage the longer drive gear 118*a* which is suitably fixed on the paper feed shaft 118, so as to allow longitudional movement of shaft 118.

At the other end of shaft 118 from its drive means D, is means O for longitudinally shifting shaft 118 between selected positions as diagrammatically shown in FIG. 7. This shaft shifting means O includes a reversible drive motor 150 having a pinion 151 engaging a circular rack 152 attached to shaft 118. The motor can be driven to cause longitudinal motion of shaft 118 between selected positions, three of which are shown in FIG. 7, to cause right or left hand offsetting of the shaft 118 from the home position.

The offsetting motor 150 is controlled by suitable interface with the host machine's sheet feeding or printing control to select the desired position. As shown, a control switch 153 and cam 154 are employed to retain shaft 118 in a home position when the motor is not energized to move the shaft 118 longitudinally to the right hand or left hand offset position.

Even though there is a gap between feed rolls 119 and arched guide 115, it will be understood that bowing of the sheet between them will cause sufficient friction between the sheet and the rolls that the sheet will be moved laterally upon longitudinal movement of shaft 118. While reference is made to a sheet, it will be understood that the paper may be fed from a roll and cut to sheet length as it exits the apparatus.

From the foregoing, it will now be apparent that the invention provides a structurally simple device to decurl sheets wherein the essence of the novelty resides in the fact that the decurling of sheets in the arcuate gap between arched guide 16 and the complementally arched surfaces of the rolls 19 bend the curled sheets without application of compressive force. During this decurling operation, due to the lapse of time in transit through the decurler, the sheet becomes more uniformly dry and has less tendency to recurl.

By selective operation of the offsetting mechanism to shift shaft 118 laterally, the output of the copier, printer or facsimile machine is deposited in the trays in discrete sets or jobs which are laterally offset for ease of manual separation upon removal from the receiver. This offsetting is best understood upon reference to FIG. 7, wherein feed shaft 118 and its shifting and drive means are shown in a center or home position and the shaft is shown in respective left-hand and right-hand offsetting positions.

We claim:

1. A device for removing curl from paper exiting a copier, printer or facsimile machine comprising: means for decurling sheets including a rotary driven paper feed shaft having a paper drive roll thereon and an arched guide member extending partially about said drive roll in closely spaced relation to the outer periphery of said drive roll and forming an arcuate gap exceeding the thickness of the paper to longitudinally deform the sheet between said roll and said guide and causing drive friction between said roll and the paper, means for rotating said shaft, and means for selectively laterally offsetting paper driven through the device by said shaft including means for shifting said shaft between selected longitudinally offset positions.

* * * * *